United States Patent [19]

Mathews et al.

[11] Patent Number: 4,561,134

[45] Date of Patent: Dec. 31, 1985

[54] FITTING ASSEMBLY FOR VINYL LINED POOLS

[75] Inventors: Lester R. Mathews, 9810 N. 37th St., Phoenix, Ariz. 85028; Jay Galvin, Tempe, Ariz.

[73] Assignees: Lester Mathews, Phoenix, Ariz.; Water Circ.Patents, Inc., Syracuse, N.Y.; Lucien Warner, Carefree, Ariz.

[21] Appl. No.: 658,668

[22] Filed: Oct. 9, 1984

[51] Int. Cl.[4] ..... E04H 3/18

[52] U.S. Cl. ..... 4/496; 4/498; 4/503; 4/506

[58] Field of Search ..... 4/488, 492, 496, 498, 4/503, 504, 506, 507; 285/200

[56] References Cited

U.S. PATENT DOCUMENTS

| | | | |
|---|---|---|---|
| 2,342,910 | 2/1944 | Tinnerman | 285/200 |
| 3,190,332 | 6/1965 | Bernard | 285/200 |
| 3,195,932 | 7/1965 | Morton | 285/200 |
| 3,749,424 | 7/1973 | Greene | 285/200 |
| 4,264,039 | 4/1981 | Moreland | 4/492 X |

*Primary Examiner*—Henry K. Artis

*Attorney, Agent, or Firm*—LaValle D. Ptak

[57] ABSTRACT

A fitting and faceplate cap assembly, for use in swimming pools, and the like, with vinyl liners, comprises a fitting member which extends through an opening in the wall of the pool with a flange overlying the opening on the inner surface of the pool. The fitting is hollow to adapt it for connection to water return lines or drain lines commonly used in such swimming pools. The flange on the fitting has a circular groove formed in it with a pair of enlarged recesses extending from the groove on opposite sides of the opening through the fitting. The faceplate cap includes a circular ridge with a pair of spaced projections for matingly engaging the groove and recesses in the faceplate of the fitting. A gasket is attached to the inner surface of the faceplate cap. This gasket has a tacky adhesive on the exposed surface which faces the flange so that when the cap is pressed into place over a vinyl liner (installed in a conventional manner) to engage the groove in the flange, the tacky adhesive on the gasket engages and holds the vinyl liner in place. The cap and fitting are subsequently pressed tightly together by means of a threaded insert in the common opening of the fitting and cap.

24 Claims, 13 Drawing Figures

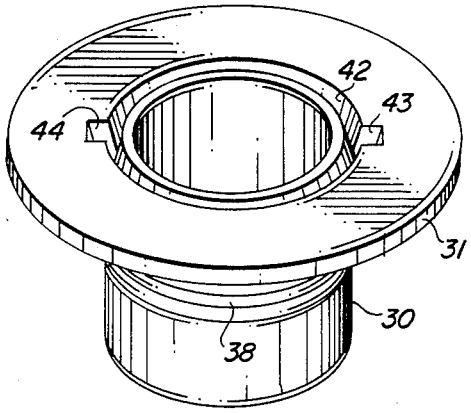
FIG. 7
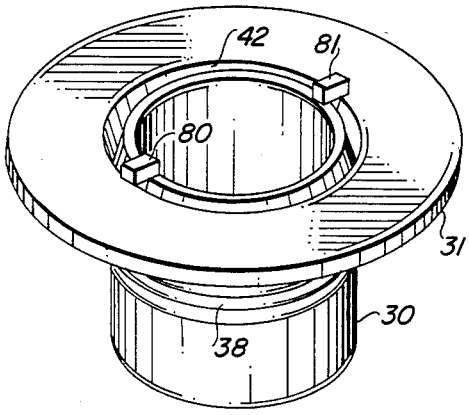
FIG. 8
FIG. 9A
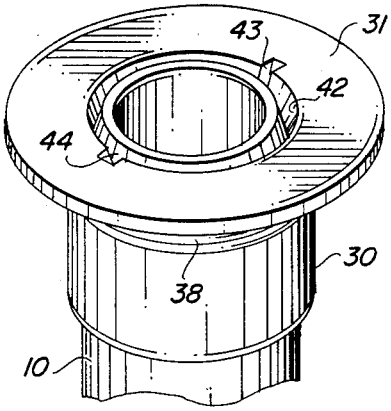
FIG. 9B
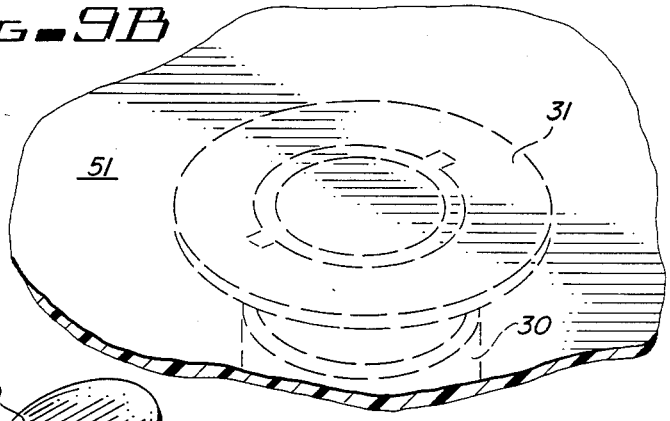
FIG. 9D
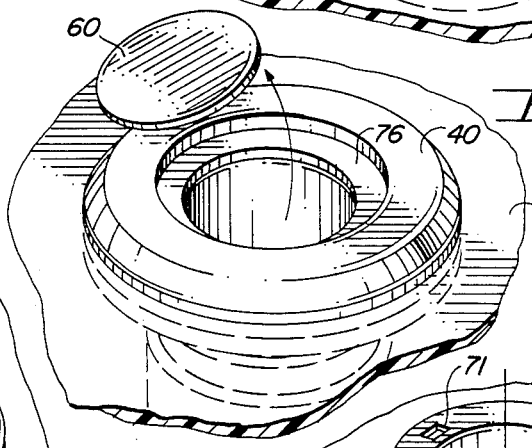
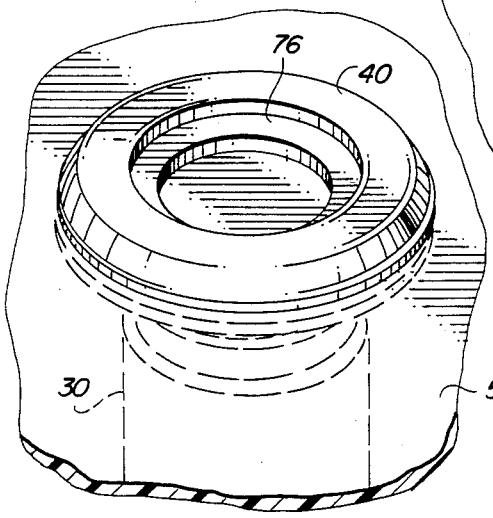
FIG. 9C
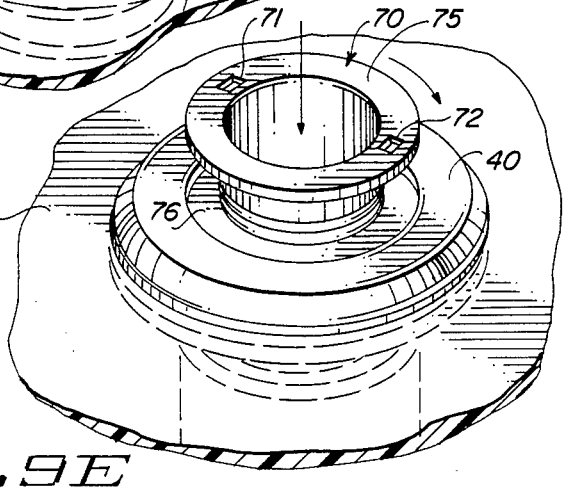
FIG. 9E

FITTING ASSEMBLY FOR VINYL LINED POOLS

BACKGROUND OF THE INVENTION

Swimming pools and spas enjoy widespread popularity in many parts of the world. Such pools and spas are built in a wide variety of shapes and with a number of different construction techniques. The most expensive installations, and the ones considered the most aesthetically appealing, are "in-ground" pools. Such pools first require an excavation first to be made in the rough dimensions of the pool. Following the initial excavation of the hole in which the pool is to be placed, different steps are taken depending upon the particular type of pool construction which is to be employed.

Many pools are made of poured concrete or gunnite concrete structure over which a final plaster coat is applied. Return lines and outlets from the pool in the form of drains and skimmers are provided at appropriate places; and once the plaster finish has been completed, the pool is filled with water and is ready for use. Concrete or gunnite pools, however, are subject to some disadvantages. In most parts of the United States and other parts of the world, pools constructed in this manner are the most expensive because of the relatively large amount of finishing work which must be employed. In addition, over a period of years of use, the plaster finish frequently becomes roughened as a result of improper chemical mixtures or as a result of physical damage from other causes. In addition, even for a "smooth" plaster surface, the surface texture is sufficiently rough that algae frequently forms and spreads on the plaster surface, especially, if the chemical balance is not continuously properly maintained. Some alge formations extend beneath the surface of the plaster and, ultimately, result in a deterioration or breaking up of the plaster finish. In addition, algae growth discolors the plaster and creates unappealing stains and blotches in the pool finish which detract from the overall apperance of the pool.

In an effort to overcome some of the disadvantages of plaster finished concrete pools, pools employing a vinyl liner have been developed. Vinyl lined pools are rapidly becoming the most popular form of pool installation in the United States. As, in the case of concrete "in-the-ground" pools, vinyl lined "in-the-ground" pools also require an excavation. The plumbing lines for fittings, for drains, returns, cleaning systems and the like are essentially the same in the case of both types of pools. Vinyl lined pools, however, use a different wall and floor construction. The floor construction generally is in the form of a sand-like bottom and does not require a reinforced concrete structure, thereby substantially reducing the cost of both labor and materials for the bottom. Similarly, the sidewalls, although frequently made of concrete base material, are simple and relatively inexpensive to install. The final finish on the inside of the pool, in contrast to concrete pools, is effected by placing a large single piece vinyl sheet over the walls and bottom of the pool. This sheet is stretched out over the completed pool opening and is pre-formed to conform to the interior shape of the pool. The sheet is attached to a coping extrusion, which extends around the upper edge of the pool and is smoothed into place over the bottom and sides of the pool.

In the installation of a vinyl liner for a swimming pool or spa, the liner has no openings which are pre-formed into it. Thus, when it is in place, it covers the drain, returns, cleaning fitting openings, skimmer openings, etc. Consequently, it is necessary to secure the vinyl liner around these openings and to then cut the liner in the appropriate shapes for each of the different inlets or outlets to the pool which ultimately will be beneath the water level of the pool when it is filled.

In the past, prior to the water level reaching the various openings in the pool, a faceplate was first secured to the fitting which projects a short distance beyond the pool wall after the vinyl is stretched and placed over the fitting opening. Because the vinyl is under considerable tension over many of these openings, it is not possible to cut a hole in the vinyl first and then apply a securing faceplate over the opening. The attachment of a faceplate or cap over each of the openings must be made while the vinyl is still stretched across the opening. Typically, this is done by first placing a gasket around the short projection of the fitting or pipe (either under or over the vinyl). A faceplate then is screwed into mating holes in the fitting behind the vinyl to secure everything in place.

To accomplish this, the screw holes in the fitting are located with a center punch. Corresponding holes, preformed into the faceplate are then aligned with the holes; and screws (usually four (4) or more) are driven through the vinyl into the holes behind it in the fitting to tightly secure the faceplate, gasket, vinyl and fitting together in a clamped sandwich. After this has been done, a sharp knife or razor blade is used to cut the vinyl liner materials from inside the faceplate so that the opening is completed through the faceplate to the communicating plumbing attached to the fitting. It is important that the screws are tightened securely and evenly to prevent any subsequent leak of the water from the pool around the fitting and behind the vinyl and/or pool wall or floor.

This procedure of securing the faceplates of the various fittings in the pool, as it is being filled to a point near the level of each of the different fittings, requires a substantial amount of time and labor on the job site. In addition, there is always the danger that the person, threading the screws through the faceplates into the fitting on the opposite side of the vinyl, may accidentally have the screw driver slip out of the screw slots and puncture or tear the vinyl adjacent the faceplate. When this occurs, and it occurs frequently, repairs to the vinyl liner must be made. This further increases the cost of installation and results in blemishes in the appearance of the completed pool, even though such vinyl repairs can be made in a long-lasting leak-proof manner.

Consequently, it is desirable to provide a more effective, simple and less costly installation of faceplates to fittings in vinyl pool constructions.

SUMMARY OF THE INVENTION

Accordingly, it is an object of this invention to provide an improved fitting assembly for vinyl lined pools.

It is another object of this invention to provide an improved fitting assembly for vinyl lined pools which is simple to install.

It is an additional object of this invention to provide a fitting assembly for vinyl lined pools which minimizes the labor required for installation at the pool site.

It is a further object of this invention to provide an improved fitting assembly for vinyl lined pools which eliminates the necessity of using screws in the assembly at the job site.

In accordance with a preferred embodiment of this invention, an improved fitting and faceplate cap assembly, for use in pools with a vinyl liner, includes a fitting member which extends through an opening in the wall of the pool to be located behind the vinyl liner of the pool. This member has a flange on it for engaging the wall surface around the opening on the inside of the pool and this flange is constructed in a configuration to facilitate and insure proper alignment of a faceplate cap on its outer surface. A faceplate cap has an opening through it which is dimensioned to correspond to a similar opening through the fitting member and is dimensioned to overlie at least a major portion of the surface of the flange on the fitting member. The cap also has a configuration for matingly engaging the surface of the flange when it is pressed toward the flange. A gasket is attached to the surface of the faceplate cap which faces the flange and the gasket has a tacky adhesive on the exposed surface, facing the flange, to engage the vinyl liner as the cap is pressed into position to mate with the flange on the fitting member.

BRIEF DESCRIPTION OF THE DRAWINGS

FIG. 7 is a top perspective view of the fitting portion of the assembly shown in FIG. 3;

FIG. 8 is an alternative embodiment of the fitting portion of the assembly shown in FIG. 3 illustrating an alternative to the structure shown in FIG. 7; and FIGS. 9A through 9E illustrate assembly steps of the embodiment shown in FIGS. 3 and 5.

DETAILED DESCRIPTION

Figure 1:
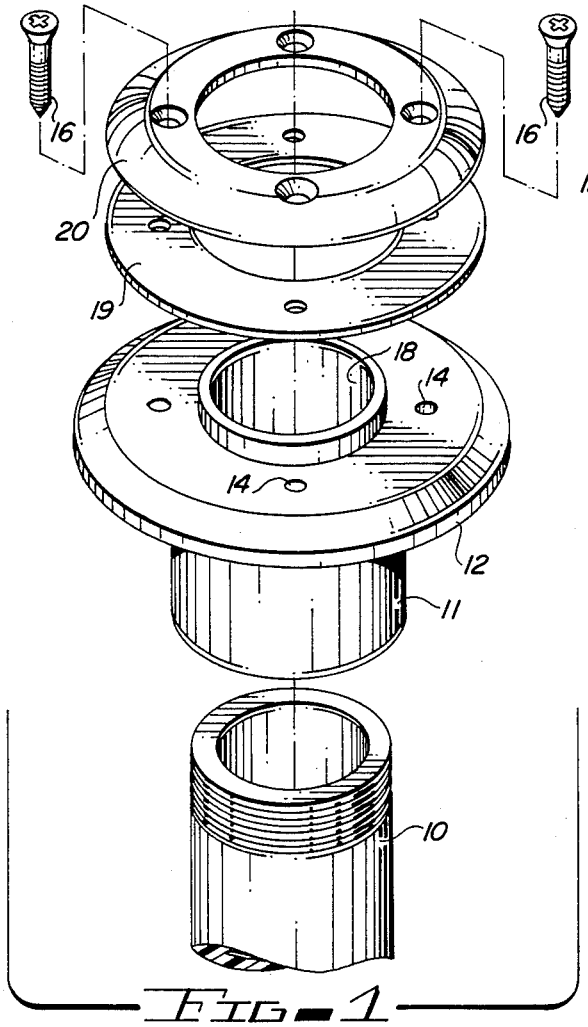
FIG. 1 (PRIOR ART)
FIG. 1 is an exploded perspective view of a typical prior art fitting and faceplate cap assembly of the type used prior to this invention.
Figure 2:
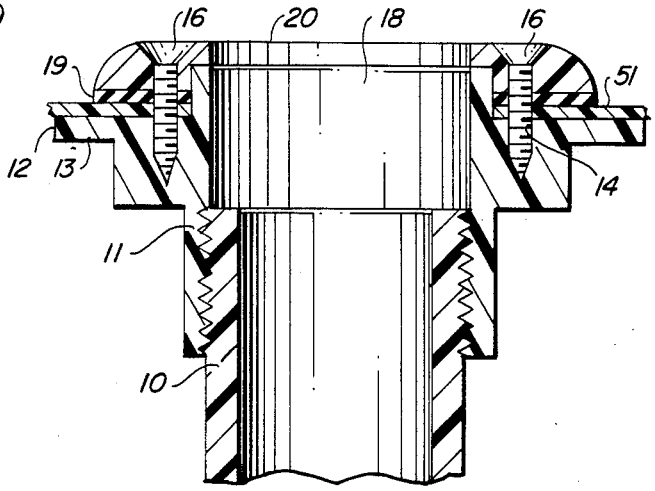
FIG. 2 (PRIOR ART)
FIG. 2 is a cross-sectional view of the assembled prior art device shown in FIG. 1.
Figure 4:
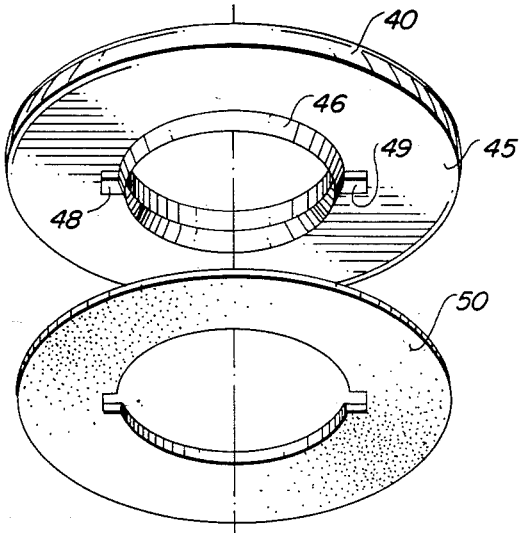
FIG. 4 is a perspective view of the faceplate cap and gasket used in the assembly of FIG. 3.
Figure 3:
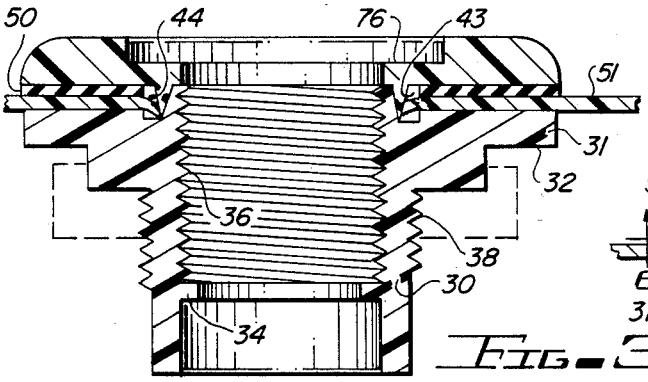
FIG. 3 is a cross-sectional view of a preferred embodiment of this invention in its assembled condition.
Figure 5:
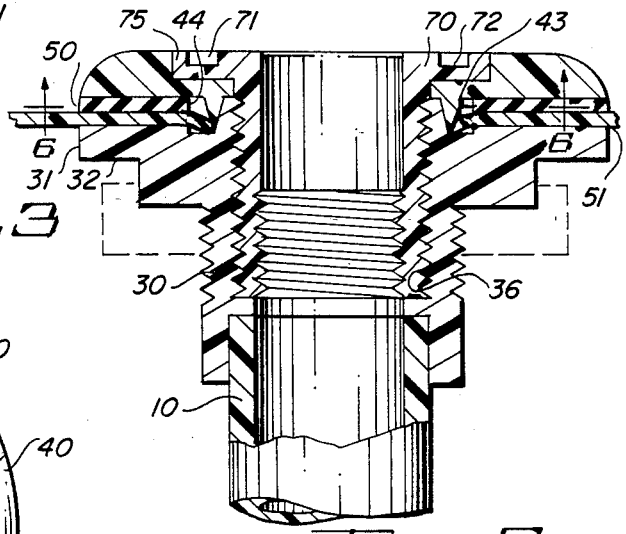
FIG. 5 is a cross-sectional view of an additional stage of the assembly shown in FIG. 3.

Reference now should be made to the drawings in which the same reference numbers are used throughout the different Figures to designate the same or similar components. FIGS. 1 and 2 illustrate a typical fitting and faceplate/cap combination used in the prior art for return pipes, automatic pool cleaner pipes, drains, etc. in swimming pools with vinyl liners.

As illustrated in FIG. 1, a supply or return pipe 10, which constitutes a standard plumbing line and typically is made of PVC pipe, is brought to a position behind the wall or floor of a pool. A fitting 11 which comprises a portion either threaded onto the end of the pipe 10 or secured to the pipe 10 by means of a suitable standard adhesive, is brought into contact with the pipe 10 from the opposite side of a pool wall which is located behind a flange 12 which flares outwardly from the end of the fitting 11 and extends into the pool itself. The wall of the pool is not shown in FIG. 1 or in any of the other Figures of the drawings. It may be a concrete wall or, in some cases, what is known as "thin wall" pool made of fiberglass or other materials.

The pool wall, whatever type it may be, is contacted on the inside, or pool side, of the wall by the rear surface 13 of the flange 12 (as shown most clearly in FIG. 2). The flange 12, for a circular opening of the type illustrated in FIG. 1 (typically used for water return lines), also includes four holes 14 which extend partially into the material of the flange 12 as seen most clearly in FIG. 2. These holes may be internally threaded, but typically, are dimensioned so that they may be engaged by self-tapping screws, such as the screws 16 shown in FIGS. 1 and 2. The pipe 10 is connected to the fitting 11 and the flange 12 is in position, against the inside wall of the pool, prior to the installation of the vinyl liner in the pool.

As is well known, in the installation of a vinyl liner, the liner is placed at one end of the pool and then unfolded over the entire pool opening. It drops into the cavity of the pool and covers over all of the inlets and outlets to the pool. Thus, it covers the hole 18 through the center of the fitting 11 and flange 12.

As the pool is filled, and as water approaches the fitting 12, the common practice is to locate a gasket 19 and a faceplate/cap 20 which have pre-formed holes through them, in alignment with the holes 14 in the flange 12. The holes 14 are typically located with a center punch or a screw driver, and the faceplate 20 and gasket 19 are pulled into tight engagement with the vinyl liner (not shown) by inserting the screws 16 through the four holes in the faceplate 20 and tightening them into the holes 14 in the flange 12. After all four screws 16 (only two of which are shown in FIGS. 1 and 2) are securely tightened, the vinyl liner is cut from the circular opening in the center of the faceplate 20, gasket 19 and flange 12, to permit communication of the water within the pool with the water in the pipe 10 behind the fitting 11. As mentioned in the above "background" portion of this specification, installation of a faceplate 20 in this manner is time consuming and is subject to the risk of a slip of the screw driver from the heads of the screws 16. This frequently results in tearing or puncturing of the vinyl liner adjacent the faceplate 20.

Reference now should be made FIGS. 3 through 9 which illustrate a preferred embodiment of this invention. Although portions of the embodiment shown in FIGS. 3 through 9 resemble corresponding portions of the fitting/cap assembly of FIGS. 1 and 2, there are significant differences between the two assemblies; so that a different set of reference numbers are used in the remaining Figures of this Application.

A fitting 30, which corresponds in function to the fitting 11, has a flange 31 on it, with a rear surface 32 correspondingly, respectively, to the functions of the flange 12 and rear surface 13 of the fitting shown in FIGS. 1 and 2. The manner of locating and installing the fitting 30 and its flange 31 is the same as described above in conjunction with the installation of the fitting 11 in a pool. The bottom end (as viewed in FIGS. 3 and 5) of the fitting 30, is adapted for connection to a standard plumbing pipe 10 which is slip-fit into the open bottom end of the flange 30 to abut a ridge 34 of the type commonly employed in PVC fittings spaced together by means of adhesive. The circular internal opening through the fitting 30, above the ridge 34, has internal threads 36 formed in it. A portion of the outside of the fitting 30 intermediate the lower or inside surface 32 of the flange 31 and the lower end of the fitting 30, has external threads 38 formed in it to accommodate a thin wall lock nut (shown in dotted lines) for use when the fitting 30 is used in a thin wall pool. For concrete pool wall construction, the lock nut is not used and the external threads 38 serve no other purpose other than inherently providing a secure non-slip bonding to a concrete wall formed around the fitting 30.

As most clearly illustrated in conjunction with FIGS. 3 through 7, significant differences are present in the structure of the faceplate 31 and a faceplate/cap 40 when these components are contrasted with the corresponding flange 12 and faceplate/cap 20 of the prior art embodiment shown in FIGS. 1 and 2. The faceplate 31, has an annular groove 42 formed concentrically around the central opening through the fitting 30. This groove is seen most clearly in FIG. 7. On opposite sides of the groove 42, a pair of extended cut-outs in the form of small rectangular steps 43 and 44, are formed.

The undersurface 45 of the cap 40 has a mating annular ridge 46 formed around the opening in the cap and concentric with it and also includes a pair of outwardly extending opposing ears 48 and 49 which align with and matingly engage the rectangular cut-outs 44 and 43, respectively, in the outer or pool side surface of the flange 31. It should be noted that there are no screw holes formed through the faceplate/cap 40 and no screw receiving openings are formed in the outer or pool side surface of the flange 31.

Figure 6:
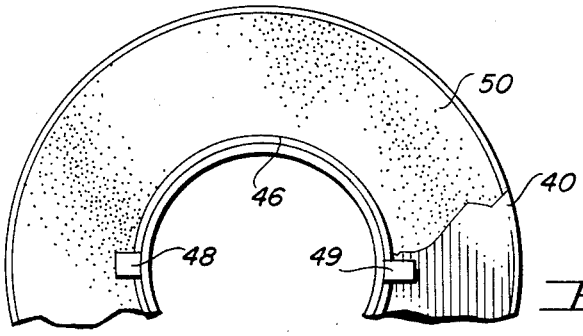
FIG. 6 is a partially cutaway bottom view of the cap and gasket shown in FIG. 4.

The cap 40 has a gasket 50 (shown in FIG. 4 in exploded view) secured to its lower surface. This is done in a preassembly step for a preferred installation. The exposed surface of the gasket 50 is coated with or constitutes a tacky adhesive material capable of tight bonding with the material used in a vinyl liner and is chemically compatible with the vinyl liner. This adhesive covers the entire exposed surface of the gasket 50; and FIG. 6 is a partially cut-away view illustrating the appearance of the undersurface of the cap 40 with the gasket 50 in place, prior to its installation in a pool, as described below.

In conjunction with the installation of a vinyl liner 51 in a pool, the vinyl liner is pulled over the fitting (with the cap 40 not in place) to cover the opening through the fitting 30 in the same manner described above in conjunction with the embodiment of FIG. 1. Once the water level rises near the fitting opening, the cap 40 and its attached gasket 50 are pressed in place over the liner 51 to cause the ridge 46 on the underside of the cap 40 to be seated in and press into the groove 42 in the flange 31, through the vinyl liner 51, with the ears or projections 48 and 49 being seated, respectively, in the cut-outs 44 and 43 in the flange 41. At this point, the cap 40 is simply pressed into place; and the adhesive on the exposed surface of the gasket 50 firmly grips the vinyl liner 51 all around the opening through the cap 40 and through the center of the fitting 30. This is sufficient to hold the vinyl liner in place, and the cap 40 cannot turn because of the engagement of the ears 48 and 49 in the rectangular cut-outs 44 and 43 of the flange 31.

Reference now should be made to FIGS. 9A through 9E, which illustrate the step-by-step assembly in conjunction with the installation and securing of a vinyl pool line 51 in accordance with the foregoing description. FIG. 9A illustrates the fitting 30 and flange 31 in position in a pool wall (not shown) ready for receipt of the vinyl lining of the pool. FIG. 9B shows a section of vinyl lining 51 in palce completely covering the flange 31 of FIG. 9A. FIG. 9C then illustrates the placement of the faceplate/cap 40 and gasket 50 over the flange 31 to engage the groove 42 and cut-outs 43 and 44 in the manner indicated previously. Location of the cut-outs and the groove 42 is established readily by the installer running a finger around the opening through the flange 31 to locate the cut-outs 43 and 44. The projections 48 and 49 on the underside of the faceplate/cap 40 are aligned with these depressions as sensed through the vinyl liner 51. The cap 40 is pressed into tight engagement with the vinyl liner 51 and through the liner 51 to seat the ridge 46 and projections 49 and 48 in the groove 42 and (cut-outs) 43 and 44 to form the sandwich sub-assembly shown in FIG. 9C. Once this has been done, the vinyl liner portion in the center of the opening, or hole through the cap 40 is cut out and removed as illustrated by the disc 60 of FIG. 9D.

At this point in the sub-assembly, the vinyl liner 51 is securely held in place; but the structure is not fully completed. Completion of the fitting then is accomplished by means of an insert member 70 which may be in a variety of different forms. It may constitute a pop-up in-the-floor cleaning head of the type widely used in swimming pool construction today. A typical head of this type is illustrated in U.S. Pat. No. 4,371,944 to Lester R. Mathews, issued Feb. 8, 1983. The fitting 70 also may be a threaded fitting for a spa "eyeball" head or it simply may constitute a conventional pool return outlet. In any event, the fitting 70 is externally threaded (as shown most clearly in FIG. 5) to engage the internal threads 36 of the fitting 30. It then is threaded downwardly by engagement of a suitable tool extended into a pair of spaced recesses 71 and 72 (shown most clearly in FIGS. 5 and 9E) to cause an outwardly extending flange 75 on the fitting 70 to engage a recessed shoulder 76 formed in the outer surface of the cap 40 concentrically around the opening through the cap 40. As the fitting 70 is tightened by threading it downwardly into engagement with the threads 36 in the fitting 30, the flange 75 presses against the shoulder 76 to pull the entire assembly together in a tight sandwich arrangement as shown most clearly in FIG. 5. If, at some subsequent time, it should be desired to use a different fitting 70, the fitting 70 is removed by turning it in the opposite direction to unthread it. A new fitting 70 then may be installed. Because of the adhesive 50, which bonds the vinyl liner 51 to the cap 40, the integrity of the remainder of the assembly is not disturbed and a new fitting may be inserted.

It readily can be seen that the assembly, which is illustrated in FIGS. 3 through 7 and 9A through 9D, has several advantages over the prior art assembly shown in FIGS. 1 and 2. There is far less danger of tearing the vinyl liner 51 with the assembly of FIGS. 3 through 9 than with the prior art assembly of FIGS. 1 and 2. In addition, installation is much quicker and is accomplished more easily. A fewer number of parts are used; and the surface of the cap 40, since it is not full of holes and screws, is far more aesthetically pleasing than the prior art assembly with its multiple screws and holes.

FIG. 8 illustrates an alternative embodiment to the one shown in FIGS. 1 through 7. In FIG. 8, the flange 31 has a pair of rectangular protrusions 80 and 81 extending upwardly from the groove 42 in place of the recesses 43 and 44 which are shown in the embodiment of FIGS. 3 through 7. For use with the configuration shown in FIG. 8, the corresponding cap 40 would have a pair of recesses located in the place of the projections 48 and 49 shown most clearly in FIG. 4. In all other respects, an embodiment modified in this manner would operate in the same way as described previously in conjunction with the description of FIGS. 1 through 7 and FIG. 9.

Various other changes and modifications will occur to those skilled in the art without departing from the true scope of the invention. The embodiments shown in FIGS. 1 through 9E are to be considered illustrative only of the invention and not as limiting. For example, the groove and ring configuration which is used to align and secure the flange and cap together, could be replaced by other mating engagement combinations of slots and protrusions to accomplish the same purpose. Similarly, the specific configurations of the parts, their relative dimensions, and the like are not to be considered as critical since the concepts which are employed are applicable to a variety of different component shapes. Such variations, which do not depart from the claimed scope of the invention, are to be considered as encompassed by the invention illustrated in the various figures of the drawing and described above.

We claim:

1. An improved fitting and cap assembly for use in conjunction with an opening through the wall of a pool with a vinyl liner, including in combination:

a fitting member extending through an opening in a wall of the pool and having a flange for engaging the interior wall surface around the opening through the wall of the pool, the flange of said fitting member having a cap-alignment means on the outer surface thereof;

a cap having an opening therein and dimensioned to overlie at least a major portion of the surface of the flange on said fitting member, said cap further having engaging means thereon for matingly engaging the alignment means on the flange of said fitting member; and a gasket on the surface of said cap which faces the flange, said gasket having a tacky adhesive on the surface thereof facing the flange when said cap is positioned over the flange with the engaging means of said cap engaging the alignment means on the flange.

2. The combination according to claim 1, wherein one of said alignment means and said engaging means comprises male projections and the other of said alignment means and said engaging means comprises mating female recesses.

3. The combination according to claim 2, wherein said gasket is made of resilient material.

4. The combination according to claim 3, wherein the alignment means on the outer surface of the flange on said fitting member comprises a groove in such flange around the opening through said fitting member and extending at least a major portion of the distance around such opening, and the engaging means on said cap comprises a ridge for engagement into the groove in the flange of said fitting member and dimensioned to extend into the groove on such flange.

5. The combination according to claim 4, further including rotation prevention means on at least said cap to prevent rotation of said cap when it is in position with the ridge thereon engaging the groove in the flange of said fitting member.

6. The combination according to claim 5, wherein said rotation prevention means comprises a discontinuity in the groove in the flange of said fitting member and a mating discontinuity in the ridge on said cap for cooperative engagement with one another.

7. The combination, according to claim 6, wherein said fitting and the flange thereon have a circular opening therethrough for communication with plumbing adapted to be attached to said fitting member and wherein the opening in said cap is a circular opening aligned with the opening in the flange of said fitting.

8. The combination, according to claim 1, wherein said fitting and the flange thereon have a circular opening therethrough for communication with plumbing adapted to be attached to said fitting member and wherein the opening in said cap is a circular opening aligned with the opening in the flange of said fitting.

9. The combination according to claim 8 wherein the opening in said fitting member is internally threaded for receipt of externally threaded inserts therein.

10. The combination according to claim 9 wherein said cap has a shoulder thereon encircling the opening therethrough and facing the pool interior when said cap is positioned over said flange for engagement by flanges on inserts threaded into said fitting member, whereby said cap is pressed into firm engagement against the flange of said fitting whenever a threaded insert is tightened into engagement with the threads of said fitting member.

11. The combination according to claim 10, wherein one of said alignment means and said engaging means comprises male projections and the other of said alignment means and said engaging means comprises mating female recesses.

12. The combination according to claim 11, wherein said gasket is made of resilient material.

13. The combination according to claim 12, wherein the alignment means on the outer surface of the flange on said fitting member comprises a groove in such flange around the opening through said fitting member and extending at least a major portion of the distance around such opening, and the engaging means on said cap comprises a ridge for engagement into the groove in the flange of said fitting member and dimensioned to extend into the groove on such flange.

14. The combination according to claim 13, further including rotation prevention means on at least said cap to prevent rotation of said cap when it is in position with the ridge thereon engaging the groove in the flange of said fitting member.

15. The combination according to claim 14, wherein said rotation prevention means comprises a discontinuity in the groove in the flange of said fitting member and a mating discontinuity in the ridge on said cap for cooperative engagement with one another.

16. An improved fitting and cap assembly for use in conjunction with an opening through the well of a pool with a vinyl liner, including in combination:

a fitting member extending through an opening in a wall of the pool and having a flange for engaging the interior wall surface around the opening through the wall of the pool, the flange of said fitting member having a cap-engagement outer surface around a central opening therethrough;

a cap having an opening therein for alignment with the opening through said flange and dimensioned to overlie at least a major portion of the surface of the flange on said fitting member, said cap further having a surface thereon for matingly engaging the cap engagement surface on the flange of said fitting member;

a gasket on the surface of said cap which faces the flange; and means extending into said fitting member through the central opening in said flange for securing said fitting member and said cap together.

17. The combination according to claim 16, wherein said gasket is made of resilient material.

18. The combination according to claim 17, further including alignment means on the outer surface of the flanges on said fitting member in the form of a groove in such flange around the opening through said fitting member and extending at least a major portion of the distance around such opening; and corresponding engaging means on said cap in the form of a ridge for engagement into the groove in the flange of said fitting member and dimensioned to extend into the groove on such flange.

19. The combination according to claim 18, further including rotation prevention means on at least said cap to prevent rotation of said cap when it is in position with the ridge thereon engaging the groove in the flange of said fitting member.

20. The combination according to claim 19, wherein said rotation prevention means comprises a discontinuity in the groove in the flange of said fitting member and a mating discontinuity in the ridge on said cap for cooperative engagement with one another.

21. The combination, according to claim 16, wherein said fitting and the flange thereon have a circular opening therethrough for communication with plumbing adapted to be attached to said fitting member and wherein the opening in said cap is a circular opening aligned with the opening in the flange of said fitting.

22. The combination according to claim 21 wherein the opening in said fitting member is internally threaded for receipt of externally threaded inserts therein.

23. The combination according to claim 22 wherein said cap has a shoulder thereon encircling the opening therethrough and facing the pool interior when said cap is positioned over said flange for engagement by flanges on inserts threaded into said fitting member, whereby said cap is pressed into firm engagement against the flange of said fitting whenever a threaded insert is tightened into engagement with the threads of said fitting member.

24. A cap assembly for use in conjunction with a fitting in an opening through the wall of a pool with a vinyl liner, including in combination:

a cap having an opening therein for alignment with the opening through the wall of the pool; and a gasket on the surface of said cap which faces such opening, said gasket having a tacky adhesive on the surface thereof for engaging and holding the vinyl pool liner when said cap is positioned over the opening and pressed toward the opening.

* * * * *